US007836826B2

(12) United States Patent
Yamamoto et al.

(10) Patent No.: US 7,836,826 B2
(45) Date of Patent: Nov. 23, 2010

(54) DAMPENING WATER REGULATING SCALE, AND DAMPENING WATER CONTROL METHOD

(75) Inventors: Takaharu Yamamoto, Kyoto (JP); Minoru Iwamoto, Kyoto (JP)

(73) Assignee: Dainippon Screen MFG Co., Ltd., Kyoto (JP)

( * ) Notice: Subject to any disclaimer, the term of this patent is extended or adjusted under 35 U.S.C. 154(b) by 648 days.

(21) Appl. No.: 11/334,457

(22) Filed: Jan. 19, 2006

(65) Prior Publication Data

US 2006/0180042 A1 Aug. 17, 2006

(30) Foreign Application Priority Data

Feb. 16, 2005 (JP) ..... 2005-038558

(51) Int. Cl.
*B41F 33/00* (2006.01)

(52) U.S. Cl. ..... 101/484; 101/450.1

(58) Field of Classification Search ..... 101/147, 101/148, 365, 450.1, 483, 484
See application file for complete search history.

(56) References Cited

U.S. PATENT DOCUMENTS

| | | | | |
|---|---|---|---|---|
| 4,677,298 | A | 6/1987 | Zelmanovic et al. | |
| 5,258,925 | A | 11/1993 | Maier et al. | |
| 6,601,512 | B2 | 8/2003 | Yamamoto et al. | |
| 6,796,227 | B1 | 9/2004 | Miller | |
| 6,918,339 | B2 | 7/2005 | Yamamoto et al. | |
| 2002/0139272 | A1* | 10/2002 | Yamamoto et al. | 101/484 |
| 2003/0070570 | A1 | 4/2003 | Yamamoto et al. | |
| 2003/0217654 | A1* | 11/2003 | Yamamoto et al. | 101/148 |
| 2004/0141765 | A1* | 7/2004 | Shimura et al. | 399/49 |
| 2004/0159254 | A1 | 8/2004 | Mogi et al. | |
| 2004/0177784 | A1* | 9/2004 | Yamamoto et al. | 101/484 |
| 2004/0226469 | A1 | 11/2004 | Yamamoto et al. | |
| 2006/0162590 | A1 | 7/2006 | Yamamoto | |

FOREIGN PATENT DOCUMENTS

| | | |
|---|---|---|
| EP | 1245388 | 10/2002 |
| EP | 1 477 314 A1 | 11/2004 |
| EP | 1 685 960 A2 | 8/2006 |
| JP | 04-103351 | 4/1992 |
| JP | 2831107 | 9/1992 |
| JP | 07-266547 | 10/1995 |
| JP | 11-268231 | 10/1999 |
| JP | 2002-355950 | 12/2002 |

* cited by examiner

*Primary Examiner*—Judy Nguyen
*Assistant Examiner*—David Banh
(74) *Attorney, Agent, or Firm*—McDermott Will & Emery LLP

(57) ABSTRACT

A dampening water regulating scale P includes first detecting patches PY1, PM1, PC1 and PK1, and second detecting patches PY2, PM2, PC2 and PK2. The first detecting patches PY1, PM1, PC1 and PK1 are formed of line patches having the number of lines at 400 lines per inch and a duty ratio at 67%. The second detecting patches PY2, PM2, PC2 and PK2 are formed of dot patches having the number of lines at 150 and a dot percentage at 80%.

6 Claims, 5 Drawing Sheets

DAMPENING WATER REGULATING SCALE, AND DAMPENING WATER CONTROL METHOD

BACKGROUND OF THE INVENTION

1. Field of the Invention

This invention relates to a dampening water regulating scale, and a dampening water control method using the dampening water regulating scale.

2. Description of the Related Art

In a lithographic printing that uses dampening water, the feed rate of dampening water is known to influence print quality. In actual practice, generally, an experienced operator visually checks prints, and empirically determines a feed rate of dampening water. In one conventional technique, a film thickness of dampening water on the surface of a printing plate or a dampening water roller is measured, and control is carried out to maintain the film thickness constant.

In view of the above situation, Applicants herein have proposed a dampening water control method for printing, along with a subject image, detecting patches that show density variations occurring with variations in dampening water, and controlling the feed rate of dampening water while measuring densities of the detecting patches (e.g. Japanese Unexamined Patent Publication No. 2002-355950).

The above dampening water control method is capable of automatically controlling the feed rate of dampening water by measuring the densities of the detecting patches. This assures a proper feed rate of dampening water without relying on the operator's experience. However, the above prior method still requires the operator to determine visually the propriety of the feed rate of dampening water during a printing operation.

SUMMARY OF THE INVENTION

The object of this invention, therefore, is to provide a dampening water regulating scale and a dampening water control method which enable even operators with little or no experience to determine visually the propriety of the feed rate of dampening water with ease.

The above object is fulfilled, according to this invention, by a dampening water regulating scale for regulating a feed rate of dampening water, comprising a first detecting patch including lines or dots and having at least 200 lines and an area ratio of at least 60%; and a second detecting patch including lines or dots and having a smaller number of lines and a larger area ratio than the first detecting patch; wherein the first detecting patch and the second detecting patch have substantially the same density when the feed rate of dampening water is controlled properly, With this dampening water regulating scale, even an operator with little experience can visually determine the propriety of the feed rate of dampening water with ease by comparing the images of the first detecting patch and second detecting patch.

In a preferred embodiment, the number of lines of the first detecting patch is set to at least 300.

The first detecting patch may include lines, and the second detecting patch dots.

The first detecting patch and second detecting patch may be arranged adjacent each other.

In another aspect of the invention, a dampening water control method is provided for controlling a feed rate of dampening water by using a dampening water regulating scale, comprising a platemaking step for making a printing plate having a first detecting patch including lines or dots and having at least 200 lines and an area ratio of at least 60%, and a second detecting patch including lines or dots and having a smaller number of lines and a larger area ratio than the first detecting patch; a test printing step for making prints with the printing plate made in the platemaking step and with dampening water supplied at a proper feed rate; a confirming step for confirming a combination of an area ratio of the first detecting patch and an area ratio of the second detecting patch that causes an agreement in density between the first detecting patch and the second detecting patch on the prints made in the test printing step; a printing step for printing, along with an actual subject image, images of the first detecting patch and the second detecting patch having the area ratios confirmed in the confirming step; and a determining step for determining propriety of the feed rate of dampening water by comparing the images of the first detecting patch and the second detecting patch printed in the printing step.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter with reference to the drawings.

Figure 1:
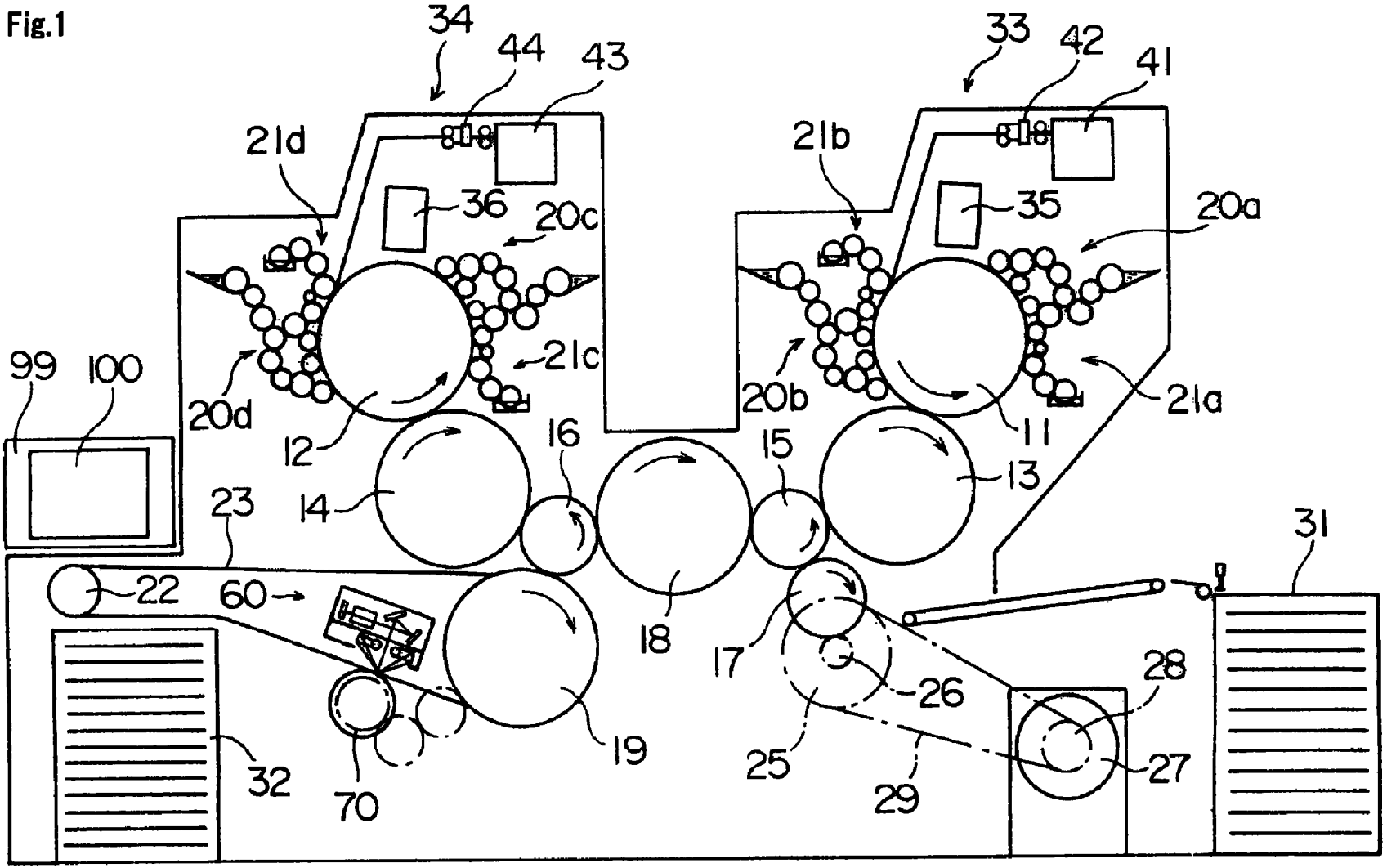
FIG. 1 is a schematic side view of a printing machine that controls the feed rate of dampening water according to this invention.

The construction of a printing machine that controls the feed rate of dampening water according to this invention will be described first. FIG. 1 is a schematic side view of the printing machine.

This printing machine records images on blank plates mounted on first and second plate cylinders 11 and 12 in a prepress process, feeds inks to the plates having the images recorded thereon, and transfers the inks from the plates through first and second blanket cylinders 13 and 14 to printing paper held on first and second impression cylinders 15 and 16, thereby printing the images in four colors on the printing paper.

The printing machine has the first plate cylinder 11, the second plate cylinder 12, the first blanket cylinder 13 contactable with the first plate cylinder 11, the second blanket cylinder 14 contactable with the second plate cylinder 12, the first impression cylinder 15 contactable with the first blanket cylinder 13, and the second impression cylinder 16 contactable with the second blanket cylinder 14. The printing machine further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, a paper discharge cylinder 19 with chains 23 wound thereon and extending to and wound on sprockets 22 for discharging printed paper from the second impression cylinder 16 to a paper discharge station 32, an image pickup station 60 for reading images and measuring densities of detecting patches printed on the printing paper, and a control panel 100 of the touch panel type acting as an input device and a display device.

Each of the first and second plate cylinders 11 and 12 is what is called a two-segmented cylinder for holding two printing plates peripherally thereof for printing in two different colors. The first and second blanket cylinders 13 and 14 have the same diameter as the first and second plate cylinders 11 and 12, and each has blanket surfaces for transferring images in two colors.

The first and second impression cylinders 15 and 16 movable into contact with the first and second blanket cylinders 13 and 14, respectively, have half the diameter of the first and second plate cylinders 11 and 12 and the first and second blanket cylinders 13 and 14. The first and second impression cylinders 15 and 16 have grippers, not shown, for holding and transporting the forward end of printing paper.

The paper feed cylinder 17 disposed adjacent the impression cylinder 15 has the same diameter as the first and second impression cylinders 15 and 16. The paper feed cylinder 17 has a gripper, not shown, for holding and transporting, with each intermittent rotation of the feed cylinder 17, the forward end of each sheet of printing paper fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains 23 wound around opposite ends thereof. The chains 23 are interconnected by coupling members, not shown, having a plurality of grippers, not shown, arranged thereon. When the second impression cylinder 16 transfers the printing paper to the discharge cylinder 19, one of the grippers on the discharge cylinder 17 holds the forward end of the printing paper having been held by the gripper of the second impression cylinder 16. With movement of the chains 23, the printing paper is transported to the paper discharge station 32 to be discharged thereon.

The paper feed cylinder 17 has a gear attached to an end thereof and connected to a gear 26 disposed coaxially with a driven pulley 25. A belt 29 is wound around and extends between the driven pulley 25 and a drive pulley 28 rotatable by a printing motor 27. Thus, the paper feed cylinder 17 is rotatable by drive of the printing motor 27. The first and second plate cylinders 11 and 12, first and second blanket cylinders 13 and 14, first and second impression cylinders 15 and 16, paper feed cylinder 17, transfer cylinder 18 and paper discharge cylinder 19 are coupled to one another by gears attached to ends thereof, respectively. Thus, by the drive of printing motor 27, the paper feed cylinder 17, first and second impression cylinders 15 and 16, paper discharge cylinder 19, first and second blanket cylinders 13 and 14, first and second plate cylinders 11 and 12 and transfer cylinder 18 are rotatable synchronously with one another.

The first plate cylinder 11 is surrounded by an ink feeder 20*a* for feeding an ink of black (K), for example, to a plate, an ink feeder 20*b* for feeding an ink of cyan (C), for example, to a plate, and dampening water feeders 21*a* and 21*b* for feeding dampening water to the plates. The second plate cylinder 12 is surrounded by an ink feeder 20*c* for feeding an ink of magenta (M), for example, to a plate, an ink feeder 20*d* for feeding an ink of yellow (Y), for example, to a plate, and dampening water feeders 21*c* and 21*d* for feeding dampening water to the plates.

Further, arranged around the first and second plate cylinders 11 and 12 are a plate feeder 33 for feeding plates to the peripheral surface of the first plate cylinder 11, a plate feeder 34 for feeding plates to the peripheral surface of the second plate cylinder 12, an image recorder 35 for recording images, based on image data, on the plates mounted peripherally of the first plate cylinder 11, and an image recorder 36 for recording images, based on the image data, on the plates mounted peripherally of the second plate cylinder 12.

In the printing machine having the above construction, a printing plate stock drawn from a supply cassette 41 of the plate feeder 33 is cut to a predetermined size by a cutter 42. The forward end of each plate in cut sheet form is guided by guide rollers and guide members, not shown, and is clamped by clamps of the first plate cylinder 11. Then, the first plate cylinder 11 is driven by a motor, not shown, to rotate at low speed, whereby the plate is wrapped around the peripheral surface of the first plate cylinder 11. The rear end of the plate is clamped by other clamps of the first plate cylinder 11. While, in this state, the first plate cylinder 11 is rotated at high speed, the image recorder 35 irradiates the surface of the plate mounted peripherally of the first plate cylinder 11 with a modulated laser beam for recording an image thereon.

Similarly, a printing plate stock drawn from a supply cassette 43 of the plate feeder 34 is cut to the predetermined size by a cutter 44. The forward end of each plate in cut sheet form is guided by guide rollers and guide members, not shown, and is clamped by clamps of the second plate cylinder 12. Then, the second plate cylinder 12 is driven by a motor, not shown, to rotate at high speed, whereby the plate is wrapped around the peripheral surface of the second plate cylinder 12. The rear end of the plate is clamped by other clamps of the second plate cylinder 12. While, in this state, the second plate cylinder 12 is rotated at low speed, the image recorder 36 irradiates the surface of the plate mounted peripherally of the second plate cylinder 12 with a modulated laser beam for recording an image thereon.

The first plate cylinder 11 has, mounted peripherally thereof, a plate for printing in black ink and a plate for printing in cyan ink. The two plates are arranged in evenly separated positions (i.e. in positions separated from each other by 180 degrees). The image recorder 35 records images on these plates. Similarly, the second plate cylinder 12 has, mounted peripherally thereof, a plate for printing in magenta ink and a plate for printing in yellow ink. The two plates also are arranged in evenly separated positions, and the image recorder 36 records images on these plates, to complete a prepress process.

The prepress process is followed by a printing process for printing the printing paper with the plates mounted on the first and second plate cylinders 11 and 12. This printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. These inks are transferred from the plates to the corresponding regions of the first and second blanket cylinders 13 and 14, respectively.

Then, the printing paper is fed to the paper feed cylinder 17. The printing paper is subsequently passed from the paper feed cylinder 17 to the first impression cylinder 15. The impression cylinder 15 having received the printing paper continues to rotate. Since the first impression cylinder 15 has half the diameter of the first plate cylinder 11 and the first blanket cylinder 13, the black ink is transferred to the printing paper wrapped around the first impression cylinder 15 in its first rotation, and the cyan ink in its second rotation.

After the first impression cylinder 15 makes two rotations, the printing paper is passed from the first impression cylinder 15 to the second impression cylinder 16 through the transfer cylinder 18. The second impression cylinder 16 having received the printing paper continues to rotate. Since the second impression cylinder 16 has half the diameter of the second plate cylinder 12 and the second blanket cylinder 14, the magenta ink is transferred to the printing paper wrapped around the second impression cylinder 16 in its first rotation, and the yellow ink in its second rotation.

The forward end of the printing paper printed in the four colors in this way is passed from the second impression cylinder 16 to the paper discharge cylinder 19. The printing paper is transported by the pair of chains 23 toward the paper discharge station 32 to be discharged thereon.

After the printing process, the printing paper printed is discharged. The first and second blanket cylinders 13 and 14 are cleaned by a blanket cylinder cleaning device, not shown, to complete the printing process.

Figure 2:
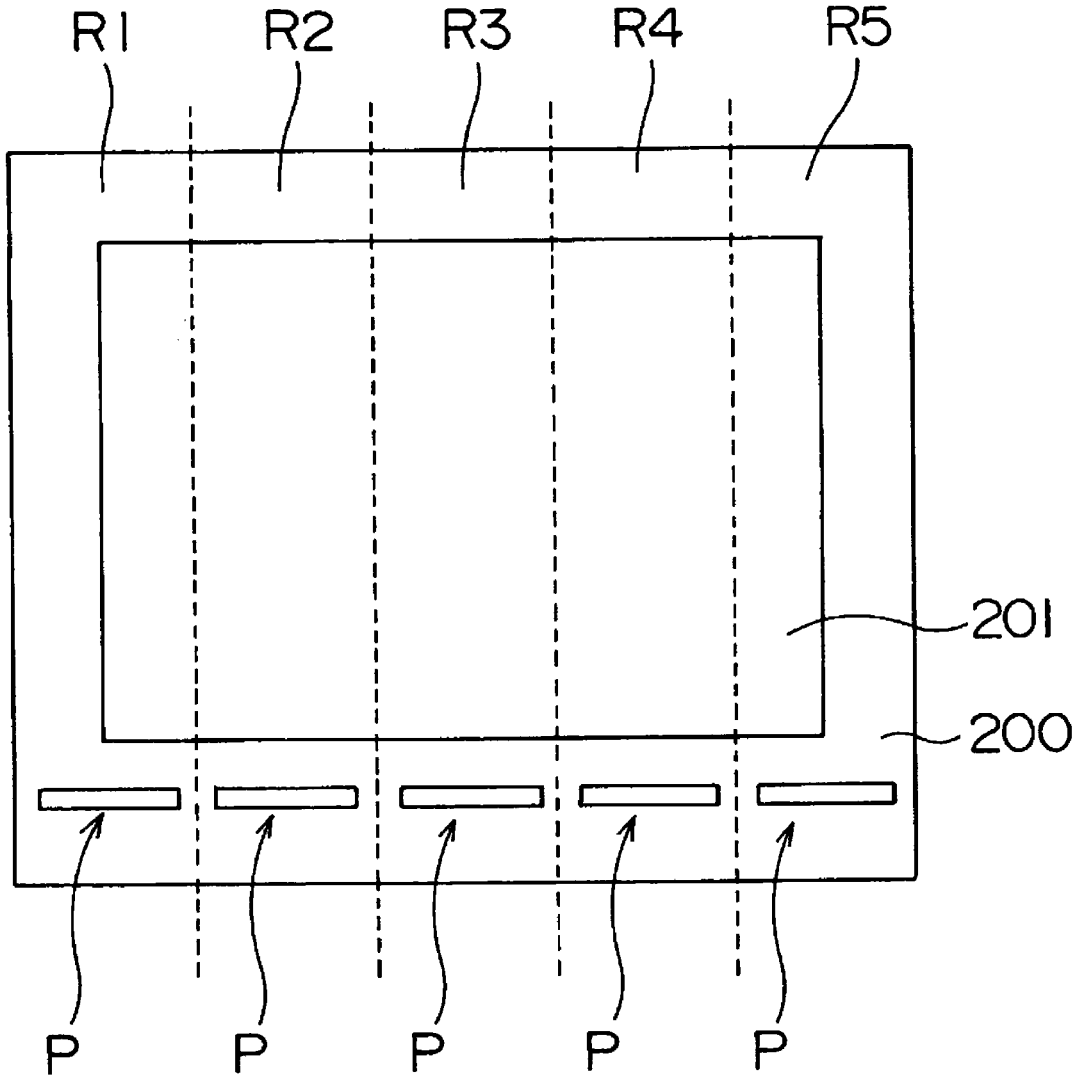
FIG. 2 is an explanatory view showing a sheet of printing paper having dampening water regulating scales printed thereon along with a subject image.

Next, a dampening water control method applicable to the above printing machine and using dampening water regulating scales according to this invention will be described. FIG. 2 is a schematic view showing a sheet of printing paper 200 having dampening water regulating scales P printed thereon along with a subject image 201.

The printing sheet 200 has a plurality of dampening water regulating scales P printed thereon in regions R1-R5 corresponding to the respective ink keys in each ink feeder 20 of the printing machine.

Figure 3A:
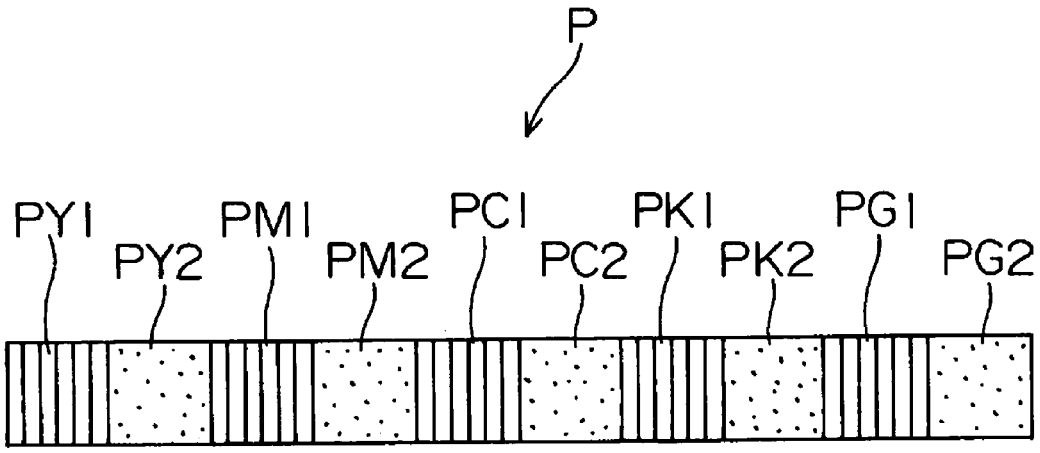
FIG. 3A is an explanatory view of a dampening water regulating scale.
Figure 3B:
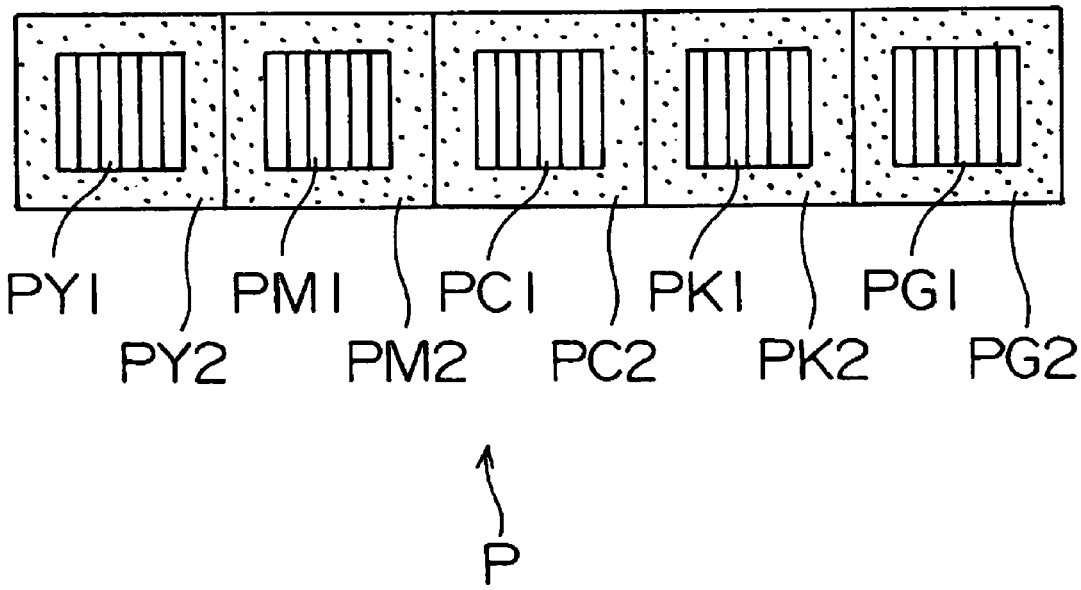
FIG. 3B is an explanatory view of a different dampening water regulating scale.

FIGS. 3A and 3B are explanatory view showing the dampening water regulating scales P.

Each dampening water regulating scale P includes a first detecting patch PY1 printed in yellow ink, a second detecting patch PY2 printed in yellow ink, a first detecting patch PM1 printed in magenta ink, a second detecting patch PM2 printed in magenta ink, a first detecting patch PC1 printed in cyan ink, a second detecting patch PC2 printed in cyan ink, a first detecting patch PK1 printed in black ink, a second detecting patch PK2 printed in black ink, a first detecting patch PG1 printed in yellow and cyan inks, and a second detecting patch PG2 printed in yellow and cyan inks.

FIG. 3A shows an example of the first detecting patches PY1, PM1, PC1, PK1 and PG1 and the second detecting patches PY2, PM2, PC2, PK2 and PG2 arranged adjacent each other, respectively. FIG. 3B shows an example of the first detecting patches PY1, PM1, PC1, PK1 and PG1 arranged within the second detecting patches PY2, PM2, PC2, PK2 and PG2, respectively.

The first detecting patches PY1, PM1, PC1 and PK1 are line patches (patches having lines), each having the number of lines (i.e. the number of lines formed per inch and representing resolution; also called screen ruling) at 400, and a duty ratio (or area ratio), which indicates a proportion of printing areas to the total area, at 67%. The second detecting patches PY2, PM2, PC2 and PK2 are dot patches (patches having dots), each having the number of lines at 150, and a dot percentage (or area ratio) at 80%.

On the other hand, the first detecting patch PG1 is formed of a line patch printed in yellow ink, and having the number of lines at 400 and a duty ratio at 67%, and dots printed in cyan ink, having a dot percentage at 10% and superposed uniformly on the line patch. The second detecting patch PG2 is formed of a dot patch printed in yellow ink, and having the number of lines at 150 and a dot percentage at 80%, and dots printed in cyan ink, having a dot percentage at 10% and superposed uniformly on the dot patch.

For the first detecting patch PG1 and second detecting patch PG2 noted above, the dot percentage may be set appropriately as long as the dots in cyan ink of the same dot percentage are superposed on the patches, respectively. However, for a visual checking of the density of yellow, a low dot percentage at about 10% is suitable.

For expediency of description, all of the second detecting patches PY2, PM2, PC2, PK2 and PG2 have a dot percentage set to 80%. In an actual situation, dot percentage differs from color to color.

The dampening water regulating scales P are used for visually determining propriety of the feed rate of dampening water. That is, the propriety of the feed rate of dampening water to a printing plate for yellow is determined by visually comparing the first detecting patch PY1 and second detecting patch PY2. The propriety of the feed rate of dampening water to a printing plate for magenta is determined by visually comparing the first detecting patch PM1 and second detecting patch PM2. The propriety of the feed rate of dampening water to a printing plate for cyan is determined by visually comparing the first detecting patch PC1 and second detecting patch PC2. The propriety of the feed rate of dampening water to a printing plate for black is determined by visually comparing the first detecting patch PK1 and second detecting patch PK2.

It is difficult for the human eye to determine the density of yellow ink. Thus, the propriety of dampening water to the printing plate for yellow is determined by using also the first detecting patch PG1 and second detecting patch PG2 formed by mixing yellow with cyan to create green. Instead of using the green created by mixing yellow with cyan, it is possible to use orange created by mixing yellow with magenta, or dark yellow created by mixing yellow with black.

The propriety of the feed rate of dampening water can be determined by visually comparing the first detecting patches PY1, PM1, PC1, PK1 and PG1 and the second detecting patches PY2, PM2, PC2, PK2 and PG2 for the following reason.

The first detecting patches PY1, PM1, PC1, PK1 and PG1 with the large number of lines show large density variations in response to variations in the feed rate of dampening water. The second detecting patches PY2, PM2, PC2, PK2 and PG2 with the small number of lines show small density variations in response to variations in the feed rate of dampening water. Thus, the dot percentage (area ratio) of the second detecting patches PY2, PM2, PC2, PK2 and PG2 is made larger than the duty ratio (area ratio) of the first detecting patches PY1, PM1, PC1, PK1 and PG1. In this way, the duty ratio (area ratio) of the first detecting patches PY1, PM1, PC1, PK1 and PG1 and the dot percentage (area ratio) of the second detecting patches PY2, PM2, PC2, PK2 and PG2 are set so that a proper quantity of water results in the density of the first detecting patches PY1, PM1, PC1, PK1 and PG1 substantially corresponding to the density of the second detecting patches PY2 PM2, PC2, PK2 and PG2. This enables the propriety of the feed rate of dampening water to be determined by visually comparing the first detecting patches PY1, PM1, PC1, PK1 and PG1 and the second detecting patches PY2, PM2, PC2, PK2 and PG2.

A dampening water control method for determining the propriety of the feed rate of dampening water by using the water regulating scales P according to this invention will be described hereinafter.

In order to determine the propriety of the feed rate of dampening water, the first detecting patches PY1, PM1, PC1, PK1 and PG1 and the second detecting patches PY2, PM2, PC2, PK2 and PG2 are formed along with the subject image 201 on the printing plates in time of platemaking. Specifically, the first detecting patch PK1 and second detecting patch PK2 are formed on the printing plate for the black color by using the image recorder 35 shown in FIG. 1. Similarly, the first detecting patch PC1, second detecting patch PC2, and the dot portions of the first detecting patch PG1 and second detecting patch PG2 are formed on the printing plate for the cyan color by using the image recorder 35. The first detecting patch PM1 and second detecting patch PM2 are formed on the printing plate for the magenta color by using the image recorder 36 shown in FIG. 1. Similarly, the first detecting patch PY1 second detecting patch PY2, the first detecting patch PG1 and second detecting patch PG2 are formed on the printing plate for the yellow color by using the image recorder 36.

At this time, the first detecting patches PY1, PM1, PC1 , PK1 and the yellow portion of PG1 are the line patches having the number of lines at 400, and the duty ratio at 67%. On the other hand, as the second detecting patches PY2, PM2, PC2, PK2, and the yellow portion of PG2 a plurality of dot patches are formed having the number of lines at 150, and the dot percentage changing in increments of 1% within a range of 60%-90%, for example.

Next, a test printing is performed with the printing plates made. And printing plates used when the feed rate of dampening water has become proper is visually determined.

Figure 4:
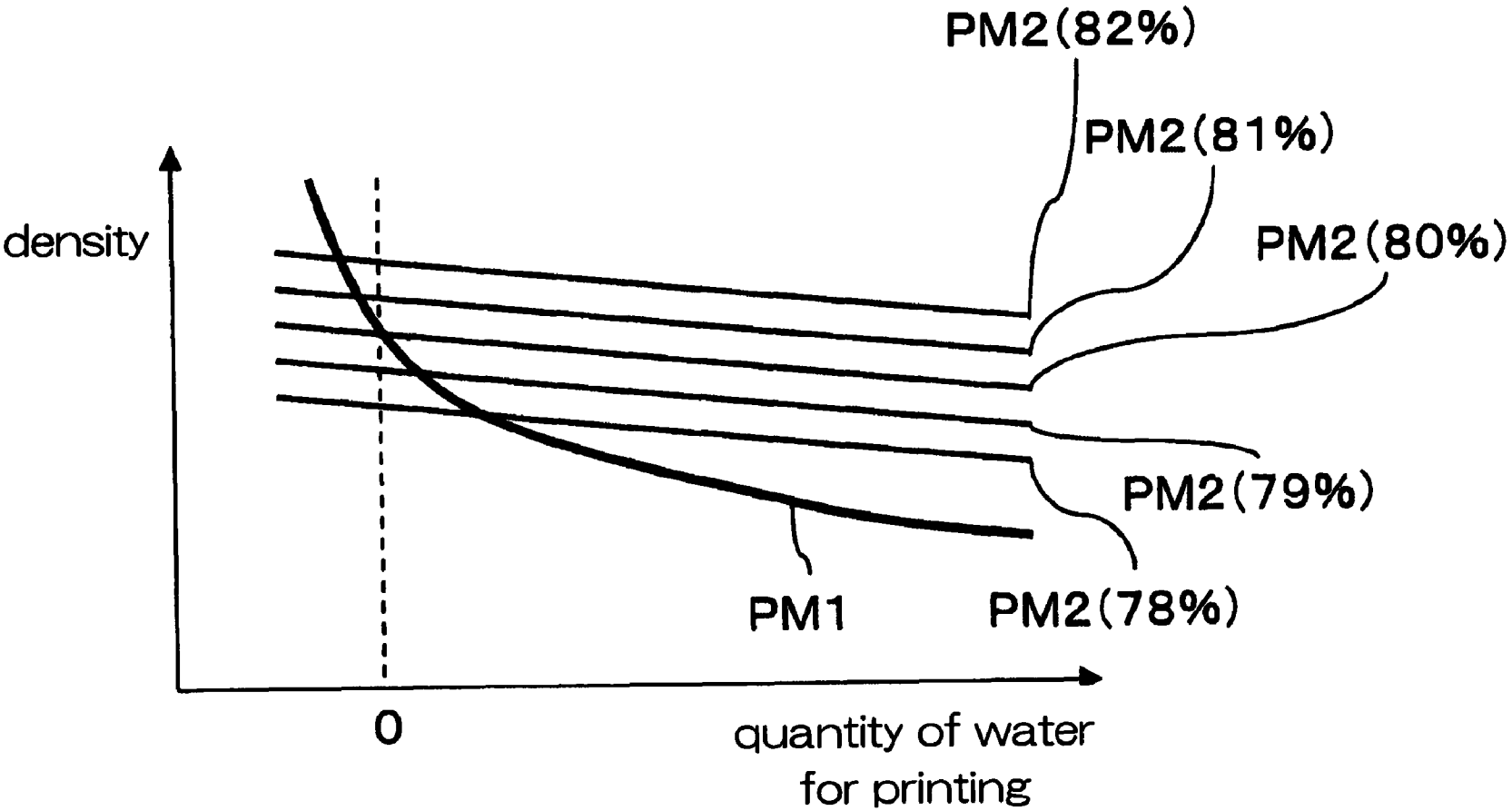
FIG. 4 is a graph showing a relationship between the feed rate of dampening water and the density of each detecting patch in time of printing.

FIG. 4 is a graph schematically showing a relationship between the feed rate of dampening water (quantity of water for printing) and the density of detecting patch PM1, PM2 at this printing time.

In this graph, the vertical axis represents the density of the detecting patches, while the horizontal axis represents the quantity of water for printing. The point 0 on the horizontal axis indicates a state of a proper quantity of water for printing. The thick line shows variations in the density of the first detecting patch PM1, and the thin lines show variations in the density of the second detecting patch PM2, for example. The thin lines show variations in density where the dot percentages of the second detecting patch PM2 are 82%, 81%, 80%, 79% and 78% from top.

As described above, the first detecting patch PM1 with a large number of lines has large density variations occurring with variations in the feed rate of dampening water. The second detecting patch PM2 with a small number of lines has small density variations occurring with variations in the feed rate of dampening water. In this graph, when the dot percentage of the second detecting patch PM2 is 80% and the feed rate of dampening water is controlled to be proper, the densities of the first detecting patch and second detecting patch are substantially the same. Consequently, this test printing validates a combination of a duty ratio of the first detecting patch and a dot percentage of the second detecting patch that brings the densities of the first detecting patch PM1 and second detecting patch PM2 into agreement when printed with a proper feed rate of dampening water. This applies also to the other colors.

While, in the above example, the numbers of lines are fixed to 400 and 150, the number of lines may be changed to adjust density. That is, when the number of lines is relatively small, an increase in the feed rate of dampening water will lower density. The feed rate of dampening water and density are in a linear relationship. When the number of lines is relatively large, an increase of dampening water may result in region of high density. Thus, the relationship between the feed rate of dampening water and density may describe an approximately U-shaped curve. It is therefore possible to adjust the number of lines instead of adjusting area percentage.

In this case, a test printing may be carried out with a plurality of dot patches serving as the second detecting patches PY2, PM2, PC2, PK2, and the yellow portion of PG2, which dot patches have numbers of lines successively varying in the range of 125 to 175, for example.

Figure 5:
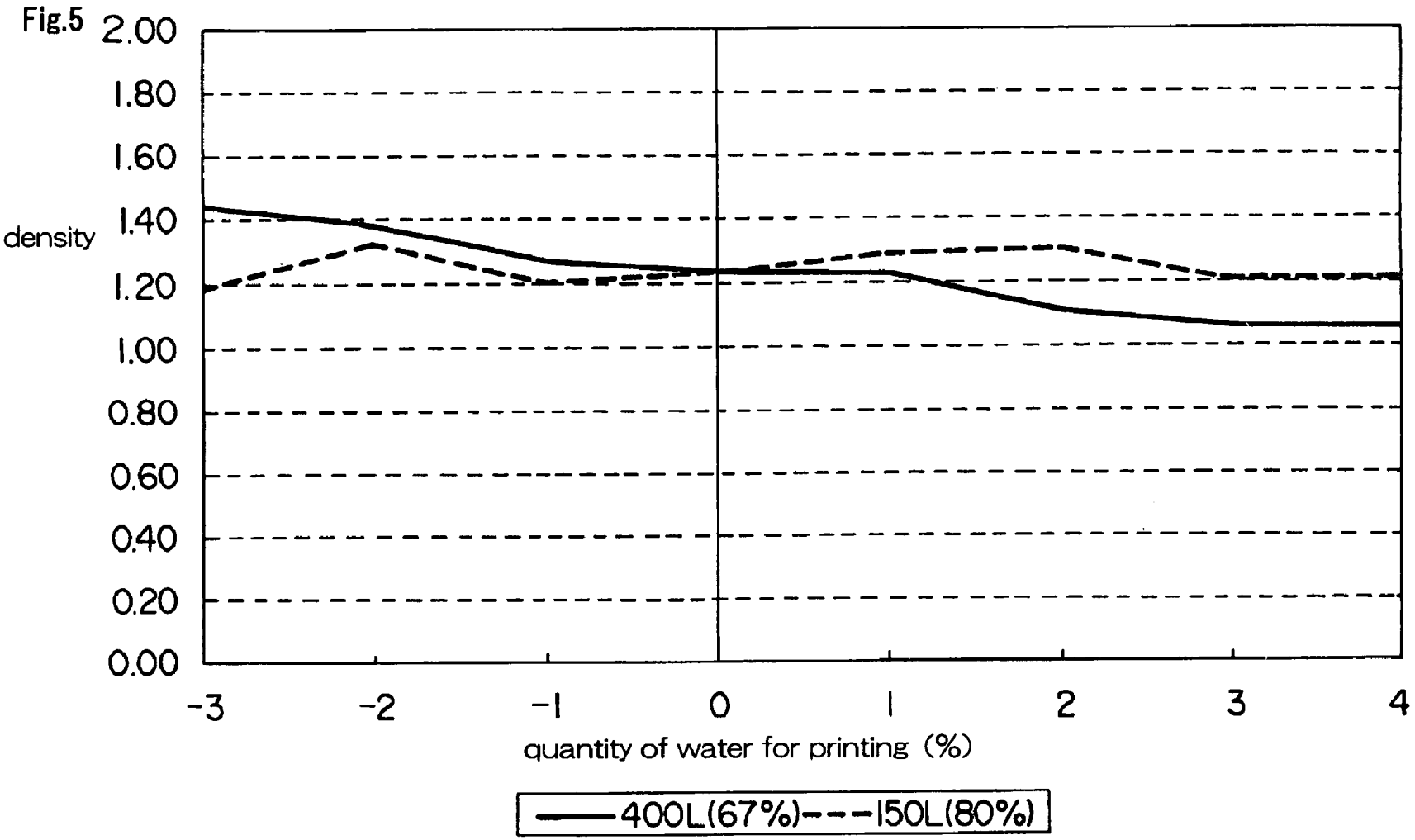
FIG. 5 is a graph showing a relationship between the feed rate of dampening water and the density of detecting patches in time of printing.

FIG. 5 is a graph showing a relationship between the feed rate of dampening water (quantity of water for printing) and density of the detecting patches PK1, PK2 in time of printing. It will be seen from this graph that the first detecting patch PK1, which is a line patch, having the number of lines at 400 and the duty ratio at 67% and the detecting patch PK2, which is a dot patch, having the number of lines at 150 and the dot percentage at 80% become nearly equal in density when the feed rate of the dampening water is proper.

Once the first detecting line patch PK1 having 400 lines and the 67% duty ratio and the detecting dot patch PK2 having 150 lines and 80 dot percent are determined to become substantially equal in density when the feed rate of the dampening water is proper, these first and second detecting patches PK1 and PK2 are formed simultaneously with a black image when making a plate for the black image to be actually printed. This is done for the other colors also. However, as noted hereinbefore, the second detecting patches PY2, PM2, PC2 and PG2 then have dot percentages differing from color to color.

Then, a subject image is actually printed, and a visual comparison is made between the densities of the first detecting patches PY1, PM1, PC1, PK1 and PG1, and the densities of the second detecting patches PY2, PM2, PC2, PK2 and PG2. When the density of the first detecting patch PY1, PM1, PC1, PK1 or PG1, and the density of the second detecting patch PY2, PM2, PC2, PK2 or PG2 are in agreement, the feed rate of dampening water used in printing the color corresponding to the patches in agreement may be determined proper.

For the yellow color, the propriety of the feed rate of dampening water may be determined by comparing the first and second detecting patches PY1 and PY2. At this time, the first and second green detecting patches PG1 and PG2 may be omitted. However, where a visual determination for yellow is difficult, the first and second green detecting patches PG1 and PG2 are used. In this case, the densities of the first and second detecting patches PG1 and PG2 are influenced not only by the feed rate of dampening water for yellow but also by the feed rate for cyan. It is therefore desirable to compare the densities of the first and the second detecting patches PG1 and PG2 after the feed rate of dampening water for the cyan color is determined to be proper.

When comparing the detecting patches described above, it is difficult to confirm visually their density differences, but which density is higher or lower can be determined relatively easily. Thus, it is possible to determine whether dampening water should be increased or decreased. As shown in FIGS. 3A and 3B, the first detecting patches PY1, PM1, PC1, PK1 and PG1 and the second detecting patches PY2, PM2, PC2, PK2 and PG2 are arranged adjacent each other. When the first detecting patches PY1, PM1, PC1, PK1 and PG1 and the second detecting patches PY2, PM2, PC2, PK2 and PG2 are used, even an operator with little experience can determine the propriety of the feed rate of dampening water with ease.

In the embodiment described above, line patches are used as the first detecting patches PY1, PM1, PC1, PK1 and PG1 for regulating the feed rate of dampening water. However, dot patches may be employed instead.

In the embodiment described above, dot patches are used as the second detecting patches PY2, PM2, PC2, PK2 and PG2. This is done in order to avoid a situation where line patches with a small number of lines have the lines standing out in time of visual checking, thereby making a confirmation of density difficult. However, line patches may be used as the second detecting patches PY2, PM2, PC2, PK2 and PG2.

The number of lines in the first detecting patches PY1, PM1, PC1, PK1 and PG1 described above, desirably, is 200 or more and, more desirably, 300 or more in order to provide large density variations in response to variations in the quantity of water for printing. A preferred duty ratio (area ratio) is 60% or higher. When the duty ratio were set to a low value less than 60%, density variations relative to the quantity of water for printing would describe a U-shaped curve in the graph shown in FIG. 4, which is undesirable. The number of lines in the second detecting patches PY2, PM2, PC2, PK2 and PG2, desirably, is less than 200 and, more desirably, 175 or less. This setting is selected to reduce density variations of the second detecting patches PY2, PM2, PC2, PK2 and PG2 relative to variations in the quantity of water for printing. Using the combination of such detecting patches has the advantage of enabling the propriety of the feed rate of dampening water to be determined by visual comparison of the densities.

In the embodiment described above, the detecting patches are arranged for the respective ink key regions. The propriety of the feed rate of dampening water may be determined as long as at least one set of different color detecting patches is present on each sheet of printing paper. However, the propriety of the feed rate of dampening water may be determined with increased accuracy by arranging sets of detecting patches in a plurality of positions transversely of the printing direction.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2005-038558 filed in the Japanese Patent Office on Feb. 16, 2005, the entire disclosure of which is incorporated herein by reference.

What is claimed is:

1. A dampening water control method for controlling a feed rate of dampening water by using a dampening water regulating scale, comprising:

a platemaking step for making a printing plate having a first detecting patch including lines or dots and having at least 200 lines per inch and an area ratio of at least 60%, and a second detecting patch including lines or dots and having a smaller number of lines per inch and a larger area ratio than said first detecting patch;

a test printing step for printing a test image with the printing plate and with dampening water supplied at a proper feed rate;

a confirming step for confirming a combination of an area ratio of said first detecting patch and an area ratio of said second detecting patch that causes a density of a portion of the test image corresponding to said first detecting patch to be substantially the same as a density of a portion of the test image corresponding to said second detecting patch;

a printing step for printing, along with an actual subject image, images of said first detecting patch and said second detecting patch having the area ratios confirmed in said confirming step; and increasing a feed rate of dampening water based on relative densities when a density of the image of the first detecting patch is greater than the density of the second detecting patch.

2. A dampening water control method for controlling a feed rate of dampening water by using a dampening water regulating scale, comprising:

a platemaking step for making a printing plate having a first detecting patch including lines or dots and having at least 200 lines per inch and an area ratio of at least 60%, and a second detecting patch including lines or dots and having a smaller number of lines per inch and a larger area ratio than said first detecting patch;

a test printing step for printing a test image with the printing plate and with dampening water supplied at a proper feed rate;

a confirming step for confirming a combination of the number of lines per inch of said first detecting patch and the number of lines per inch of said second detecting patch that causes a density of a portion of the test image corresponding to said first detecting patch to be substantially the same as a density of a portion of the test image corresponding to said second detecting patch;

a printing step for printing, along with an actual subject image, images of said first detecting patch and said second detecting patch having the numbers of lines confirmed in said confirming step; and increasing a feed rate of dampening water based on relative densities when a density of the image of the first detecting patch is greater than the density of the second detecting patch.

3. A dampening water control method as defined in claim 1, wherein the number of lines of said second detecting patch is set less than 200 lines per inch.

4. A dampening water control method as defined in claim 2, wherein the number of lines of said second detecting patch is set less than 200 lines per inch.

5. A dampening water control method as defined in claim 1, further comprising:

controlling the feed rate of dampening water such that the images of the first detecting patch and the second detecting patch have substantially the same density.

6. A dampening water control method as defined in claim 1, further comprising:

controlling the feed rate of dampening water such that the images of the first detecting patch and the second detecting patch have substantially the same density.

* * * * *